US007191632B2

(12) United States Patent
Kanehara et al.

(10) Patent No.: US 7,191,632 B2
(45) Date of Patent: Mar. 20, 2007

(54) DEVICE AND METHOD FOR MANUFACTURING RESIN COATED METAL SEAMLESS CONTAINER SHELL

(75) Inventors: Minoru Kanehara, Kanagawa (JP); Shigeru Noto, Kanagawa (JP)

(73) Assignee: Daiwa Can Company, Tokyo (JP)

( * ) Notice: Subject to any disclaimer, the term of this patent is extended or adjusted under 35 U.S.C. 154(b) by 79 days.

(21) Appl. No.: 10/492,536

(22) PCT Filed: Oct. 28, 2002

(86) PCT No.: PCT/JP02/11161

§ 371 (c)(1),
(2), (4) Date: Aug. 27, 2004

(87) PCT Pub. No.: WO03/037544

PCT Pub. Date: May 8, 2003

(65) Prior Publication Data

US 2005/0016247 A1 Jan. 27, 2005

(30) Foreign Application Priority Data

Oct. 29, 2001 (JP) ..... 2001-331632
Nov. 26, 2001 (JP) ..... 2001-359938

(51) Int. Cl.
*B21D 37/16* (2006.01)

(52) U.S. Cl. ..... 72/342.8; 72/342.4; 72/349; 72/364; 72/379.4

(58) Field of Classification Search ..... 72/342.1, 72/342.3, 342.4, 342.7, 342.8, 347, 348, 72/349, 379.4, 342.94, 364
See application file for complete search history.

(56) References Cited

U.S. PATENT DOCUMENTS

| | | | | |
|---|---|---|---|---|
| 3,340,714 | A * | 9/1967 | Karl-Heinz Pohl et al. | 72/342.4 |
| 4,148,208 | A * | 4/1979 | Maeder | 72/342.4 |
| 4,502,313 | A * | 3/1985 | Phalin et al. | 72/342.3 |
| 6,550,302 | B1 * | 4/2003 | Ghosh | 72/342.8 |
| 6,598,450 | B2 * | 7/2003 | Blue | 72/342.3 |

FOREIGN PATENT DOCUMENTS

| | | |
|---|---|---|
| EP | 0667193 | 2/1995 |
| JP | 55-16777 | 2/1980 |
| JP | 63-72435 | 4/1988 |
| JP | 4-351229 | * 12/1992 |
| JP | 5-237558 | 9/1993 |
| JP | 6-210381 | 8/1994 |
| JP | 6-305008 | 11/1994 |

(Continued)

*Primary Examiner*—Ed Tolan
(74) *Attorney, Agent, or Firm*—Oblon, Spivak, McClelland, Maier & Neustadt, P.C.

(57) ABSTRACT

In forming a can body by processing a cup-shaped in-process material with a punch and a die, the die is not heated when the forming process is not carried out, and the die is heated when the forming process is carried out. Therefore, the temperature of the die is adjusted in accordance with the temperature rise of the punch result from the forming process, a clearance between the punch and the die can be maintained, misalignment of the punch and the die can be prevented, and slip and elongation becomes preferable. Therefore, nonuniformity in the wall thickness, breakage of the can body, and breakage of a flange can be suppressed.

14 Claims, 9 Drawing Sheets

FOREIGN PATENT DOCUMENTS

| | | |
|---|---|---|
| JP | 7-57388 | 6/1995 |
| JP | 2550845 | 8/1996 |
| JP | 8-332533 | 12/1996 |
| JP | 11-104765 | 4/1999 |
| JP | 11-314122 | 11/1999 |
| JP | 2001-162344 | 6/2001 |
| JP | 2002-178048 | 6/2002 |

* cited by examiner

DEVICE AND METHOD FOR MANUFACTURING RESIN COATED METAL SEAMLESS CONTAINER SHELL

This application is a 35 USC 371 of PCT/JP02/11161, filed Oct. 28, 2002.

1. Technical Field

The present invention relates to an apparatus and a method for manufacturing a seamless can body by redrawing, redrawing/ironing, or ironing a cup-shaped in-process material formed by drawing a metallic sheet coated with a thermoplastic resin on both sides, by using a punch and a die.

2. Background Art

Generally, metal cans (containers) made of aluminum or steel are classified broadly into a three-piece can, a two-piece can and a bottle-shaped can, depending on its shape. The three-piece can is composed of a bottom lid, a can body spliced by welding or bonding, and a top lid, which is why it is called the three-piece can. The two-piece can has a structure such that the top lid is fitted to the can body integrated with the bottom lid and, therefore, it is called the two-piece can. It is also called a seamless can because there is no seam on the can body. Moreover, a bottle-shaped can is composed of a side wall seamless can body in which a screw portion is formed on one of the opening end portions of the can body, a cap is screwed on the screw portion, and the entire shape thereof is similar to that of the glass bottle such that, therefore, it is called a bottle-shaped can.

In any of the cans noted above, a protective layer of a synthetic resin is formed on an inner face of the can in order to secure corrosion resistance. In recent years, a laminated can in which a thermoplastic resin layer as the protective layer is formed has been developed, and has come into practical use. A material of a laminated can of this kind is a resin film coated metallic sheet in which the resin film is laminated on a metal material, and a can body forming, e.g., by stretching or by drawing and ironing is applied to most of those cans. However the deformation or the degree of processing of the material is considerable to form the two-piece can or two-piece can body such that, therefore, an advanced forming technique is required.

A merit of the laminated can is its excellent content resistance, especially, an excellent flavoring property such as a taste and a flavor of the content, depending on the applied organic resin film. On the other hand, a demerit thereof is a manufacturing problem. Since the processing degree (or forming degree) of the thermoplastic resin film coated metallic sheet is considerable, the resin film of the inner face may be damaged during the forming, and the quality of the inner face of the can cannot be secured. Therefore, a strict test for the quality of the cans has to be carried out and the yield ratio is inferior to that of the ordinary coated cans.

Especially, the two-piece type laminated cans made of a steel material have a strong tendency to the foregoing demerits, however, the laminated cans made of an aluminum material also have those kinds of demerits. As mentioned above, the resin film of the inner face of the laminated can is flawed during the forming. It is, therefore, a critical issue to minimize those demerits in view of the quality and the yield rate.

More specifically, in case of manufacturing the seamless can body having a bottom portion from a cup-shaped in-process material formed by drawing a metallic sheet covered with the thermoplastic resin on both sides by redrawing, by redrawing/ironing or by ironing a cup-shaped in-process material by using a punch and a die, a cooling agent (i.e., a coolant) cannot be applied to an outer face of a side wall of the can body in its forming process. It is because there is no washing step in post-process, unlike conventional methods for manufacturing a seamless can with a material which is not covered with a resin. Therefore, the temperatures of the punch and the die rise in accordance with increasing of production, immediately after the start of manufacturing. Since the temperature of the punch rises more drastically in comparison with the die, the punch expands and narrows a clearance between the punch and the die. This may thin the thickness of the can body right after the start of manufacturing, and may vary the thickness of the can body in a circumferential direction or in a width direction of a flange. Therefore, the can bodies formed before the rise of temperature of the punch is stabilized have to be eliminated from the manufacturing line as defective cans, and brakeage of the can body also deteriorates the manufacturing efficiency. Actually, these considerations are the negative factors for the manufacturing cost.

The aforementioned laminated can is also manufactured by redrawing, by redrawing/ironing or by ironing a cup-shaped in-process material made of the metallic sheet covered with the thermoplastic resin, as described above, and an apparatus for controlling the temperature of forming tools is known as the apparatus which can prevent a breakage of the can body or a cracking of the laminating resin during the production. The apparatus of this kind is disclosed in, for example, Japanese Patent Laid-Open No. 7-57388, Japanese Patent No. 2550845, Japanese Patent No. 2790072 and so on.

Here will be briefly described inventions disclosed in those publications. A method disclosed in Japanese Patent Laid-Open No. 7-57388 is for manufacturing a container in which the temperature of the punch in process is maintained within the range of 50 to 80° C. In Japanese Patent No. 2550845, there is disclosed a method for maintaining surface temperature of the die confronting a blank holder (or the blank holder confronting the die) within the range of 40 to 100° C. During the process, by flowing hot water through the die (or though both of the die and the blank holder) and switching from hot water to cold water just before the process is started, in manufacturing the seamless can, by redrawing a laminated metallic sheet, be covered with a polyester film on both sides. Moreover, in Japanese Patent No. 2790072, there is disclosed a manufacturing method of the seamless can for maintaining the surface temperature of the portion of the die in the forming process contacting with the side wall of the cup-shaped in-process material, the surface temperature of the portion of the blank holder confronting a flat face of the die, and the surface temperature of the punch right after the extraction, within a predetermined temperature range by warming of the inside of the die, the blank holder and the punch before the forming work, switching from warming to cooling right before the forming is started, and maintaining cooling during the forming.

Any of those aforementioned inventions as the prior art is the method for adjusting the temperature of the apparatus for manufacturing the seamless can, by controlling the temperature of water or by switching a liquid flowing through the forming tools. The problems which accompany such invention will be described hereinafter.

First, the invention disclosed in Japanese Patent Laid-Open No. 7-57388 is constructed to exchange the heat from inside of the punch by flowing a coolant through a liquid circuit (i.e., a flow passage) formed inside of the punch, thereby to maintain the temperature of the punch at the predetermined temperature. Therefore, the response of temperature control by the coolant is too slow in spite of the drastic change in temperature (i.e., the temperature rise) of the surface of the punch and a cooling effect is not seen right away. Accordingly, there arises a problem in that a sensitive temperature control is difficult to be carried out. Since the heat exchange rate by the coolant has to be improved in order to suppress the temperature rise due to heat generation of the punch by flowing the coolant, it is necessary to flow the coolant into the liquid circuit as much as possible. The coolant can be fed in large amounts if a cross-sectional area of the liquid circuit is enlarged. However, this is not preferable because it may deteriorate the strength of the punch. Thus, there is a limitation on the length of the liquid circuit and the cross-sectional area of the flow passage in view of the strength of the punch, so that a sufficient cooling performance cannot be secured. This arises a problem in that a temperature distribution of the punch is difficult to be equalized.

According to the invention disclosed in Japanese Patent No. 2550845 and Japanese Patent No. 2790072, moreover, the redrawing is carried out with maintaining the surface temperature of upper side of the die confronting the blank holder to an appropriate temperature (40 to 100° C.), by switching from hot water flowing though the die to cold water right before the forming process is started. Therefore, the cooling effect is not seen immediately after the switch of water and it takes time to exchange the heat, likewise the case of the aforementioned invention of Japanese Patent Laid-Open No. 7-57388. Accordingly, the response of cooling to drastic change in the temperature of the surface of the punch is too slow, and this arises a problem that a sensitive temperature control is difficult to be carried out.

Moreover, when substituting the hot water flowing through the die with the cold water, water for adjusting the temperature is fed from outside of the die to individual forming tools and is circulated therein through a punch holder (i.e., a nose holder) or a die holder. Therefore, for example, in case the die is constructed so as to have a plurality of the forming tools mounted on the common punch holder or the die holder for multiple forming, the die holder itself, which is in a warming state with the hot water flown therethrough until just before the start of manufacturing, is easy to become deformed as a result of a temperature change due to substitution between the hot water and the cold water. This causes an eccentricity between the punch mounted on the punch holder and the die mounted on the die holder. As a result of this, there arises a problem such as a variation in the wall thickness of the can body, and an easy breakage of the can body.

In order to further ascertain the aforementioned problems, the inventors of the present invention have investigated a temperature change of the punch and the die from the beginning of forming, when a redrawing, a redrawing/ironing or an ironing of the resin-coated metallic sheet is actually carried out. As a result of this, it is recognized that the temperature of the punch rises remarkably, but the temperature of the die rises slower (i.e., the temperature rise is smaller) than that of the punch. This seems to result from the fact that the contacting area between the die and the cup-shaped in-process material is smaller than that between the punch and the cup-shaped in-process material, and that the overall contacting area of the punch against the cup-shaped in-process material is large and the overall heat capacity of the punch is small on the other hand. Therefore, the difference in thermal expansion between the die and the punch (thermal expansion of the punch is larger) becomes large, if the die is switched from a warming state to a cooling state just before starting the forming simultaneously with the punch, as the aforementioned prior art. Consequently, the clearance between the die and the punch becomes smaller than a predetermined clearance so that the wall thickness of the can body is not stabilized. As a result of this, there is a possibility of forming defects such as breakage of the can body and nonuniformity in the wall thickness, a variation in the forming dimension, or a cracking of the resin film, in the beginning of the forming.

SUMMARY OF THE INVENTION

A main object of the present invention is to provide an apparatus and a method which can improve an uniformity of the wall thickness of the can body in the beginning of manufacturing, and which can prevent defects such as the breakage of the can body and the flange, at the start of manufacturing of the can body or at the restart of the manufacturing in case a feeding of the cup-shaped in-process material is temporarily halted during the continuous manufacturing to control the line speed, when the resin-coated metal seamless can body is manufactured by redrawing, by redrawing/ironing or by ironing a cup-shaped in-process material.

In order to achieve the aforementioned object, according to the present invention, there is provided an apparatus for manufacturing a resin-coated metal seamless can body having a bottom portion, by redrawing, by redrawing/ironing or by ironing a cup-shaped in-process material formed by drawing a resin-coated metallic sheet covered with a thermoplastic resin on both sides, by using a punch and a die, characterized: by heating/cooling means for heating/cooling said die; and in that said heating/cooling means puts said die into an unheated state when a forming process for forming said can body is not carried out by said punch and die, and puts said die into a heated state when the forming process for forming said can body is carried out by said punch and die.

According to the apparatus of the present invention, moreover, said heating/cooling means is characterized by comprising a function to put said die into the unheated state by feeding a low-temperature fluid into said die, and functions to put said die into the heated state by feeding a high-temperature fluid into said die.

Moreover, the apparatus according to the present invention is characterized in that said low-temperature fluid includes water having a temperature of 30° C. or lower.

Moreover, the apparatus according to the present invention is characterized in that said high-temperature fluid includes hot water having a temperature of 50 to 80° C.

Moreover, the apparatus according to the present invention is characterized by comprising constant temperature water feeding means for feeding a constant temperature water having a temperature of 20 to 80° C. during the forming process for forming said can body.

According to the present invention, moreover, there is provided a method for manufacturing a resin-coated metal seamless can body having a bottom portion by redrawing, by redrawing/ironing or by ironing a cup-shaped in-process material formed by drawing a resin-coated metallic sheet covered with a thermoplastic resin on both sides, by using a punch and a die, characterized in that said die is brought into an unheated state when said forming process for forming the can body is not carried out; and in that said die is brought into a heated state when the forming process for forming said can body is carried out.

Moreover, the method according to the present invention is characterized in that said die is brought into the unheated state by feeding the low-temperature fluid into said die, while said die is brought into the heated state by feeding the high-temperature fluid into said die.

Moreover, the method according to the present invention is characterized in that said low-temperature fluid includes water having a temperature of 30° C. or lower.

Moreover, the method according to the present invention is characterized in that said high-temperature fluid includes hot water having a temperature of 50 to 80° C.

Moreover, the method according to the present invention is characterized in that the constant temperature water having a temperature of 20 to 80° C. is fed into said punch when the forming process for forming said can body is carried out.

According to the apparatus and the method of the present invention, therefore, the die is cooled or not heated before the forming process using the punch and the die is carried out, or when the forming process is halted. On the other hand, the die is heated and its temperature is thereby raised when the forming process using the punch and the die is started, so that the temperature of the die can be adjusted in accordance with the temperature rise of the punch caused by the forming process. Therefore, the clearance between the punch and the die can be maintained, or an axial eccentricity between the punch and the die can be prevented, and the smoothness and elongation of the resin film covering the surface of the can body can be in a preferable condition. As a result, according to the apparatus and the method of the present invention, a forming defect in the course of the redrawing, the redrawing/ironing, or the ironing of the seamless can body can be suppressed or prevented in advance. The aforementioned forming defect includes a nonuniformity of the wall thickness of the can body, and a breakage of the can body and the flange formed on the opening end portion of the can body.

According to the present invention, moreover, there is provided an apparatus for manufacturing a resin-coated metal seamless can body having a bottom portion by redrawing, by redrawing/ironing or by ironing a cup-shaped in-process material formed by drawing a resin-coated metallic sheet covered with a thermoplastic resin on both sides, by using a punch and a die, characterized by comprising heating means for heating said punch from an outer face side before the forming process for forming said can body using said punch and die is started, or before the forming process is restarted after a temporary halt of the feeding of a cup-shaped in-process material during the continuous manufacturing to control the line speed, so as to raise the surface temperature of the punch to a temperature higher than that of said cup-shaped in-process material before the forming process for forming said can body is started, and to a temperature approximate to that of the punch to be reached in case of forming a plurality of the can body continuously, and for halting the heating of said punch just before the forming process for forming said can body is started or just before the halted forming process is restarted; and in that said forming process is carried out by using the punch in which heat is stored by the heating means.

Moreover, according to the present invention, there is provided a method for manufacturing a resin-coated metal seamless can body having a bottom portion by redrawing, by redrawing/ironing or by ironing a cup-shaped in-process material formed by drawing a resin-coated metallic sheet covered with a thermoplastic resin on both sides, by using a punch and a die, characterized: in that said punch is heated from the outer face side before the forming process for forming said can body is started, or before the forming process is restarted after a temporary halt of the feeding of a cup-shaped in-process material, so as to raise the surface temperature of the punch to the temperature higher than that of said cup-shaped in-process material before said forming process is started, and to the temperature approximate to that of the punch to be reached in case of forming a plurality of the can body continuously; in that the heating of the punch is halted just before the forming process for forming said can body is started, or just before the halted forming process is restarted; and in that said forming process is carried out by using the heated punch.

According to the apparatus and the method of the present invention, there is provided a constant temperature water feeding means for feeding the constant temperature water having a temperature of 20 to 80° C., therefore, the temperature of the punch can be kept approximate to the temperature of the punch to be reached in case of manufacturing can bodies continuously, by feeding the constant temperature water having a temperature of 20 to 80° C. to inside of the punch so as to minimize the temperature change of the punch during the period from the start of the continuous forming process for forming a plurality of can body after an idling state of the punch until an initial temperature of the punch is stabilized, in other words, at and around the start of manufacturing the can body. Therefore, the change in the outer diameter of the punch can be minimized, and the number of defective cans can be minimized for the initial period of manufacturing the can body from the start (or restart). Specifically, the nonuniformity of the wall thickness of the can body, the breakage of the can body, and the breakage of the flange formed on the opening end portion of the can body can be suppressed. Also, the outer circumferential face of the punch can be heated directly even if the halting time in the continuous manufacturing of the can body is short, or if a halt occurs intermittently, so that the responsiveness to the temperature change can be improved. Namely, the surface temperature of the punch can be controlled sensitively.

According to the apparatus and the method of the present invention, therefore, at least the punch is kept warmed by the constant temperature water having a temperature of 20 to 80° C. so that the difference between the temperature of the punch at the start (or restart) of production and the temperature of the punch to be reached in case of manufacturing the can bodies continuously can be minimized, regardless of the environmental temperature wherein the forming process is to be carried out, even if the environmental temperature in the summertime and in the wintertime are different each other.

Moreover, the apparatus according to the present invention is characterized by comprising cooling means for cooling said can body fitted with said punch from the outer face side, when said punch reaches a bottom dead center during the continuous forming of a plurality of can bodies.

Moreover, the method according to the present invention is characterized in that said can body fitted with said punch is cooled from the outer face side, when said punch reaches the bottom dead center in the course of continuous forming process of the can bodies.

According to the apparatus and the method of the present invention, therefore, the can body being fitted with the punch can be cooled from the outer face side at the final step of advancing process of the punch, i.e., in the vicinity of the bottom dead center of the punch stroke, and the punch can also be cooled through the can body, during the continuous manufacturing of the can bodies. Therefore, an engaging force of the can body and the die can be reduced in a return (or a rising) process of the punch. Accordingly, the seamless can body can be easily pulled out of the die. Also, the surface temperature of the resin film of the outer face can be reduced lower than a glass transitional point (Tg) of the resin, so that adhesion of the resin film onto the surface of the punch due to a softening resulting from a processing heat can be suppressed. Therefore, the seamless can body can be stripped away from the punch easily, and the scuffing on the resin film of the outer face can also be avoided.

Moreover, the apparatus according to the present invention is characterized by comprising heating means for heating at least a trunk wall of said cup-shaped in-process material to 20 to 80° C., prior to starting said forming process.

Moreover, the method according to the present invention is characterized in that at least the trunk wall of said cup-shaped in-process material is heated to 20 to 80° C., prior to starting said forming process.

According to the apparatus and the method of the present invention, therefore, the trunk wall of said cup-shaped in-process material to which the redrawing, the redrawing/ironing or the ironing is to be applied is heated to 20 to 80° C., prior to carrying out said forming process. Therefore, the forming of the can body can be started at the temperature near the glass transitional point, the formability of the can body can be improved, and the releasing property can be improved by keeping the temperature of the cup-shaped in-process material constant.

Moreover, the apparatus according to the present invention is characterized by comprising heating/cooling means for heating/cooling said die, which puts said heating/cooling means said die into the unheated state when the forming process for forming said can body is not carried out by said punch and die, and puts said die into the heated state when the forming process for forming said can body is carried out by said punch and die.

Moreover, the method according to the present invention is characterized in that said die is brought into the unheated state when said forming process for forming the can body is not carried out and in that said die is brought into the heated state when the forming process for forming said can body is carried out.

According to the apparatus and the method of the present invention, therefore, the die is cooled or not heated before the forming process by using the punch and the die is carried out, or when the forming process is halted. On the other hand, the die is heated and its temperature is thereby raised after the forming process by using the punch and the die is started, so that the temperature of the die can be adjusted in accordance with the temperature rise of the punch in accordance with the forming process. Therefore, the clearance between the punch and the die can be maintained, the axial eccentricity between the punch and the die can be prevented, and the smoothness and the elongation of the resin film formed on the surface of the can body can be in further preferable condition. As a result, according to the apparatus and method for the present invention, the forming defect during the redrawing, the redrawing/ironing or the ironing of the seamless can body can be suppressed or prevented in advance. The aforementioned forming defect includes the nonuniformity of the wall thickness of the can body, the breakage of the can body, and the breakage of the flange formed on the opening end portion of the can body.

BEST MODES FOR CARRYING OUT THE INVENTION

Figure 1:
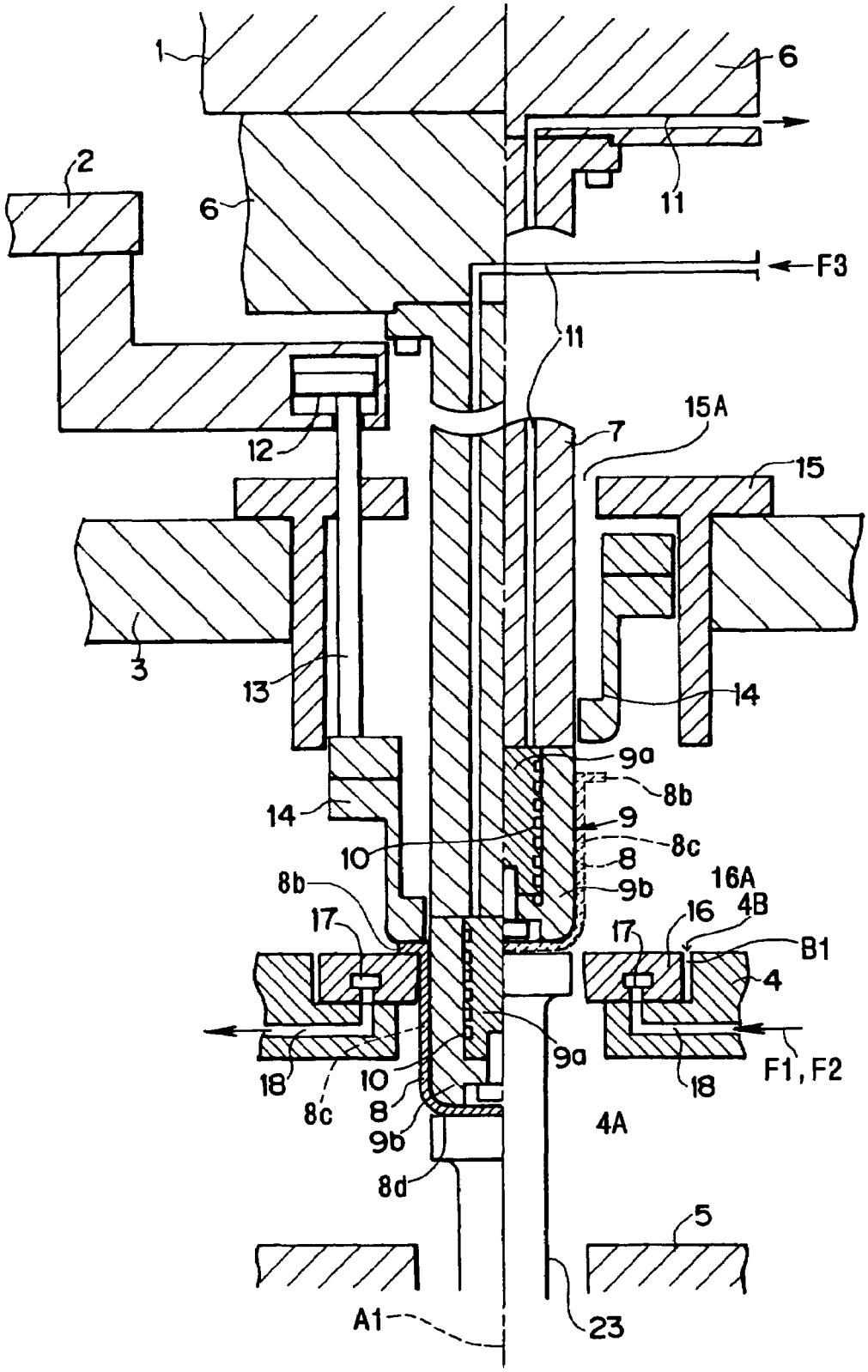
FIG. 1 is a sectional view schematically showing a first embodiment of a seamless can body manufacturing apparatus, to which the invention is applied.

Hereinafter, the present invention will be described in detail, with reference to embodiments shown in accompanying drawings. First of all, one example of a seamless can body to which the invention is applied is a can body of a bottle-shaped can with a cap put on its neck portion. This is, for example, manufactured by a process shown in FIG. 2.

A resin-coated metallic sheet covered with a thermoplastic resin on both sides is used as a material of the seamless can body. A blank 51, which is formed by punching out the resin-coated metallic sheet of FIG. 2 in a disc shape at a cup forming step, is drawn to form a cup-shaped in-process material 8. At the next forming step, the cup-shaped in-process material 8 is redrawn, redrawn/ironed or ironed at least one or more times to form a cylindrical can body 8*a* having a diametrically smaller and thin trunk portion 8*e*, and a bottom portion 8*f*. Here, in this case, bending/extending process can be carried out simultaneously.

Next, at a top doming step, first of all, a can bottom corner portion (i.e., a bottom portion and a cylindrical portion in the vicinity of the bottom portion) of said can body is formed into a curved face of a lower part of a shoulder portion having an arcuate longitudinal section, and drawn into a diametrically small bottomed cylindrical portion at the first step, so as to form a neck portion and the shoulder portion on the bottom portion 8*f* side of the can body 8*a*. At the second to third steps, the diameter of the bottomed cylindrical portion is reduced by applying the drawing to the can bottom side a plurality of times so as to be substantially equal to that of the neck portion. Then, at the fourth step, a part of the shoulder portion leading from the initial curved face of the lower part of the shoulder portion formed by the reiterated drawing is re-shaped (or reformed) into a contiguous and smooth curved face. And at the fifth and sixth steps, a mouth-drawing is applied twice to the bottomed cylindrical portion formed to have the diameter substantially equal to that of the neck portion.

At the aforementioned top doming step, the can body in which the unopened neck portion and the shoulder portion formed on the bottom corner side is formed. A lubricant adhering to the can body is removed at subsequent lubricant removing step. Then, at a following trimming step, an opening end side of the trunk portion on the other side of the neck portion is trimmed to make the can have a predetermined length. Then, at a printing/coating step, a desired design is printed on the outer face of the cylindrical trunk portion in which an end portion on the other side of the neck portion is opened, and a transparent curable coating (i.e., a clear coating) for protecting a painted outer face of the can is applied to the outer face of the trunk portion as a top coat. This printing/coating step is identical to that for the trunk portion of the cylindrical trunk portion of the ordinary two-piece can.

The printed and coated can body is sent to the subsequent drying step, and a printed ink layer and a top-coated layer are dried sufficiently. At the drying step, the laminated thermoplastic resin layer is brought into an amorphous state, by cooling to 160° C. within 8 seconds after heating at its melting point or higher. After that, at a threading/curling step, the neck portion is opened by trimming the unopened closing leading end portion of the neck portion, then an opening end portion is formed into an annular curled portion curling outward (or inward). Furthermore, a cylindrical circumference wall is threaded so as to be screwed together with a cap, and a bead portion is formed in the lower side of the threaded portion.

Next, at a necking/flanging step, an opening end portion of the lower end of the trunk portion on the other side of the neck portion is necked-in and flanged one or more times sequentially. The can body of the bottle-shaped can thus formed is sent to a not-shown bottom end seaming step, and a separated bottom lid made of a metallic sheet material is integrally fixed with a flange portion formed on the opening lower end portion of the trunk portion, by a double seaming method using a seamer (or a can end seaming machine). Thus, the bottle-shaped can is completed. A light metal sheet such as an aluminum or a surface-treated steel sheet to which various metal plating treatments or conversion coating treatments is applied are to be used for the present invention as the resin-coated metallic sheet, without any particular limitation.

As the light metal sheet, an aluminum sheet and an aluminum alloy sheet are to be used. A 3004 series or 3104 series aluminum alloy defined by Japanese Industrial Standards (JIS) is used for the aluminum alloy sheet. An ordinary method such as a chromic phosphate treatment or a zirconium phosphate treatment is applied as the surface treatment to the drawn and ironed can after the forming process, however, an organic/inorganic compound type conversion coating treatment of phosphoric acid or zirconium phosphate and an organic resin is especially effective, in case of a high processing degree, i.e., a decreasing degree of a plate thickness of the can wall portion is high. It is preferable to use a conversion coated aluminum alloy sheet, for example, the chromic phosphate treatment in which chrome is attached to the surface 1 to 40 mg/m$^2$, or the zirconium phosphate treatment in which zirconium is attached to the surface 4 to 17 mg/m$^2$, is applied thereon.

The thickness of the metallic sheet is determined according to its material, the size of the can, and use applications. In general, the aluminum alloy sheet having a thickness of 0.20 mm to 0.40 mm is to be used.

A metallic sheet normally used for can manufacturing is to be employed as the surface-treated metallic sheet, without any particular limitations. However, it is preferable to use the metallic sheet which is surface-treated in order to secure the adhesion of the thermoplastic polyester resin film. For example, a surface-treated steel sheet having a chemical conversion coating film layer is to be used, such as; an extremely thin tin plated steel sheet having a tin layer on both sides whose deposition amount is 500 to 2000 mg/m$^2$ per one side; an electrolytic chromate treated steel sheet having a chromium metal layer whose deposit amount is 50 to 200 mg/m$^2$, and a chromium hydrated oxide layer whose deposit amount is 5 to 25 mg/m$^2$ in terms of metallic chromium on top; a nickel-plated steel sheet having a nickel plating layer whose deposition amount of one side is 500 to 800 mg/m$^2$, and having a top layer whose chromium amount is 1 to 30 mg/m$^2$ in terms of metal; or an organic/inorganic compound type surface-treated steel sheet having a nickel plating layer whose deposition amount is 20 to 2000 mg/m$^2$, and having a top layer whose carbon content is 1 to 100 mg/m$^2$.

The thickness of the steel sheet is determined according to the size of the can and its use application, however, the strength of the can body, especially the pressure capacity of the bottom should be taken into consideration. In general, 0.15 mm to 0.25 mm thick is preferable.

As the resin film for covering aforementioned metallic sheet, a thermoplastic polyester resin film having an excellent heat resistance and suitable characteristics for the use application of the can is to be used. The polyester resin can be exemplified by; a homopolymer such as polyethylene terephthalate (PET), polybutylene terephthalate (PBT), or polyethylene isophthalate (PEI); a copolymer as a polymerized resin composed of e.g., polyethylene terephthalate and polyethylene isophthalate; or a resin blend of those homopolymers, a resin blend of the homopolymer and the copolymer, and a resin blend of those copolymers and so on.

Moreover, a melting point of the thermoplastic polyester resin to be used in the invention can be determined arbitrarily depending on the degree of the copolymer, selection of the resins to be blended and a blending ratio thereof. For example, a resin film whose melting point is 200 to 260° C. is employed. Besides, after laminating, the resin-coated metallic sheet according to the present invention is fused by heating to the melting point or higher of the hot glued thermoplastic resin film, and then quenched to the glass transition point or lower so as to be brought into an amorphous state. However, a resin-coated metallic sheet in which a bi-oriented crystal remains on the upper layer of the thermoplastic resin film layer can also be employed. The resin film is laminated on the metallic sheet by a thermal adhesion method, a dry-lamination method, an extrusion coating method or the like. If the adhesiveness to the coating resin is insufficient, the resin film can be thermally bonded by providing e.g., a urethane adhesive, an epoxy adhesive, an olefin adhesive, a copolyamide adhesive, or a copolyester adhesive on one side or both sides of the metallic sheet or the resin film.

Moreover, a few percentage points of titanium oxide or a white pigment, and a pigment or a toner etc. in colors other than white can be added to the adhesion to the extent that the adhesiveness and formability of the adhesion are not deteriorated.

To the resin-coated metallic sheet, there is applied one or more kinds of the lubricant agent, i.e., normal butyl stearate, fluid paraffin, petrolatum, polyethylene wax, food oil, palm oil and synthetic paraffin. The resin-coated metallic sheet to which those lubricant agents has been applied is used as a material to manufacture the bottle-shaped can of the embodiment through the manufacturing process as has been described with reference to FIG. 2.

(First Embodiment)

In the course of the forming process from the aforementioned cup forming step to necking/flanging step, the apparatus and the method according to the present invention can be applied to the can body forming step. FIG. 1 schematically shows an embodiment of applying the invention to the apparatus to be used for drawing/ironing of the can body forming step, which is constructed as a die assembly for double-action pressing. Specifically, there are arranged an inner slide 1 and an outer slide 2 in a vertically movable manner, and an intermediate plate 3 is fixedly arranged below the outer slide 2. A die holder 4 is fixedly arranged below the intermediate plate 3, and held by a die base 5 arranged thereunder.

A nose holder 6 is fixed to the lower face of the inner slide 1, and a punch-shaft 7 is installed underneath the nose holder 6. The punch-shaft 7 moves vertically along a longitudinal center axis A1, in accordance with the vertical movement of the inner slide 1. A punch 9 for drawing/ironing a cup-shaped in-process material 8 of the resin-coated metallic sheet is installed on the lower end portion of the punch-shaft 7. Here, the cup-shaped in-process material 8 comprises a cylindrical trunk wall 8*c*, a flange 8*b* leading to an opening end of the trunk wall 8*c*, and a bottom portion 8*d*.

The punch 9 is composed of a core material 9*a* and a sleeve 9*b* tightly fitted on an outer circumference of the core material 9*a*, and at least the sleeve 9*b* is formed of carbide. A spiral flow passage 10 is formed on the border between the core material 9*a* and the sleeve 9*b*, and a feeding/draining flow passage 11 formed by penetrating said nose holder 6 and punch-shaft 7 is communicated with the flow passage 10. Additionally, the feeding/draining flow passage 11 is connected to a heat source (not shown) for feeding and circulating e.g., a constant temperature water F3 of 20 to 80° C.

There is formed an opening portion into which the punch-shaft 7 and the punch 9 penetrate on said outer slide 2, and a piston 12 is provided which moves vertically in the vicinity of an inner circumference of the opening portion. A pusher pin 13 which moves integrally with the piston 12 extends downward, and a blank holder 14 is installed on a leading end portion (i.e., a lower end portion) of the pusher pin 13. The blank holder 14 is a hollow cylindrical member having an opening portion diametrically larger than said punch 9, and is constructed to press a flange 8*b* of said cup-shaped in-process material 8 by the leading end portion (i.e., a lower end portion) of the blank holder 14.

Moreover, a through hole having a larger diameter than that of the blank holder 14 is formed in the intermediate plate 3, and a cylindrical shaped blank holder guide 15 is installed in the through hole. Said pusher pin 13 penetrates the blank holder guide 15, and the punch-shaft 7 penetrates an opening 15A formed in the center portion of the blank holder guide 15.

Figure 3:
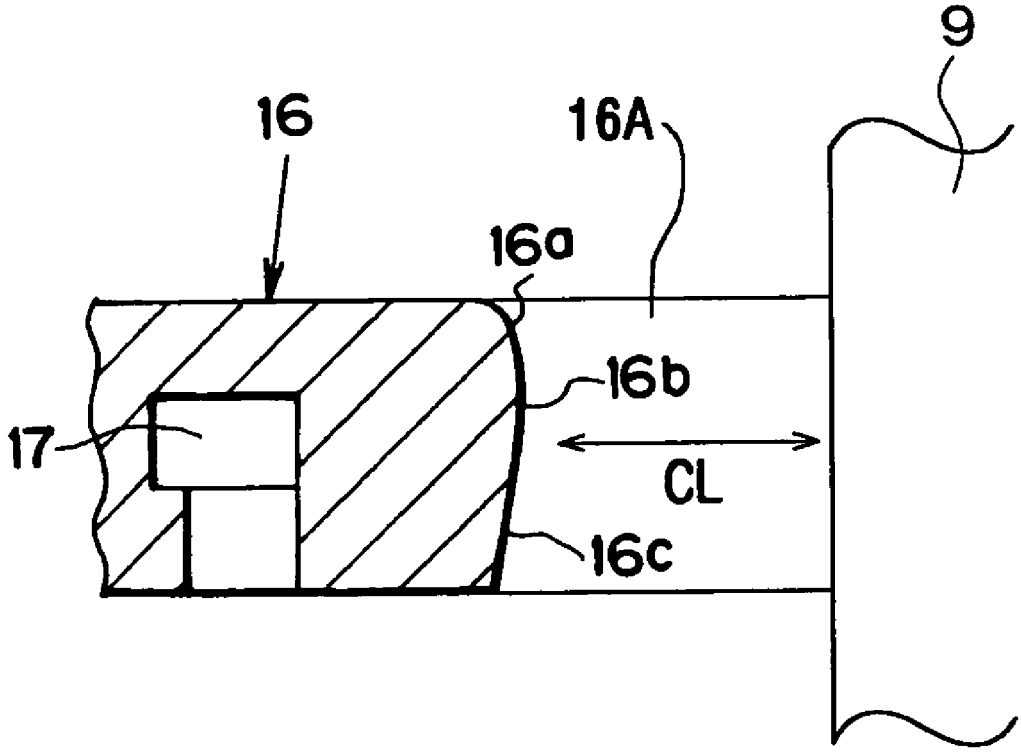
FIG. 3 is a sectional view showing a forming portion of a die in FIG. 1 in an enlarged scale.

A vertical hole 4A is formed in said die holder 4. Also, there is formed an annular shaped concave portion 4B on the upper face side of the die holder 4. A die 16 for carrying out the drawing/ironing together with the punch 9 is installed in the concave portion 4B by a pressing plate (not shown). The die 16 is held movably in the concave portion 4B so as to align with the entering punch 9 automatically. As shown in FIG. 3, the die 16 is an annular plate-shaped member having an opening 16A for the forming process formed in the center, and an inner diameter of the opening 16A is set in a measure such that a predetermined clearance CL is interposed between the outer circumferential face of said punch 9 and the inner circumferential face of the die 16. More specifically, the opening 16A of the die 16 is constructed of, beginning at the top, a tapered inlet portion 16*a* opening wider upward, a processing portion 16*b* being in parallel with the center axis A1 in FIG. 1 and having a predetermined length in the axial direction, and a tapered relief portion 16*c* leading to the lower part of the processing portion 16*b* and opening wider downward. Since a portion contacting said cup-shaped in-process material 8 or the material to be processed is limited to the processing portion 16*b* and in the vicinity thereof, a hear generating portion and a heat receiving portion in accordance with the forming process are limited in a small area of the die 16 as a whole.

Figure 4:
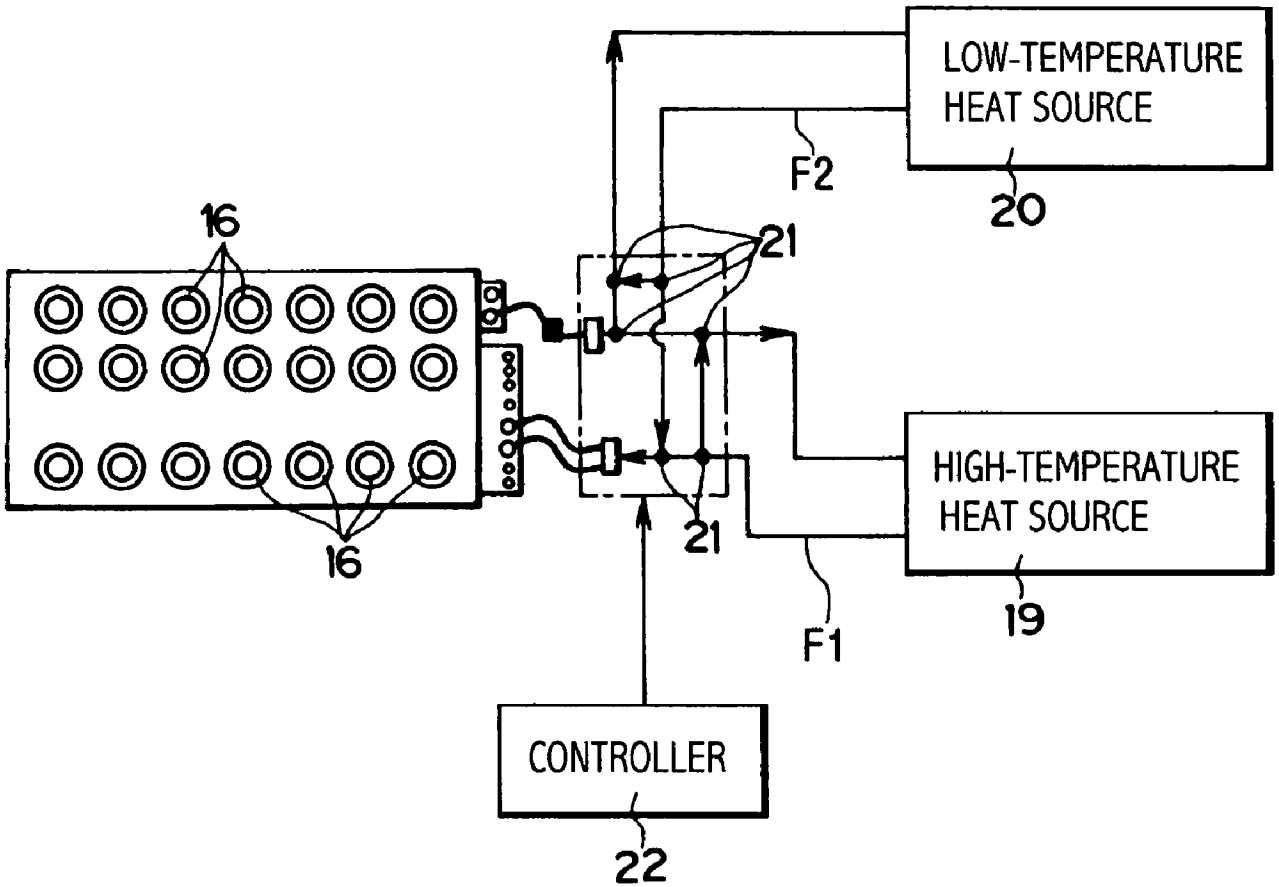
FIG. 4 is a system diagram showing a supply and drain routes of hot water and water for heating/cooling the die in FIG. 1.

Moreover, a flow passage 17 for flowing a temperature adjusting water concentrically to its processing portion 16*b* is formed inside of the die 16. This flow passage 17 and a feeding/draining passage 18 formed in the die holder 4 in which the die 16 is installed are communicated with each other at the lower face of the die 16. The flow passage 17 and a fluid for flowing in the flow passage 17 are for adjusting the temperature of the die 16 so as to correspond to that of the punch 9. As shown in FIG. 4, accordingly, the aforementioned feeding/draining passage 18 is connected to a high-temperature heat source 19 for feeding a high-temperature fluid F1 having a temperature higher than an ambient temperature, and to a low-temperature heat source 20 for feeding a low-temperature fluid F2 lower than ambient temperature. Also, the low-temperature fluid and the high-temperature fluid can be fed selectively to the die 16 by a plurality of selector valves 21 provided in a pipe conduit communicating with those heat sources 19 and 20. In order to control those selector valves 21, there is provided a controller 22. The controller 22 controls said selector valves 21 in accordance with a processing operation of a pressing machine, or the temperature rise of the punch 9 from the start of processing.

Specifically, the high-temperature heat source 19 has hot water as the high-temperature fluid F1 of approximately 50 to 80° C., and the low-temperature heat source 20 has water as the low-temperature fluid F2 of ambient temperature (approximately 30° C. or lower). Before the forming process is started, or when the forming process is halted, water is fed to and cools down the die 16, or keeps the die 16 at room temperature. Just before the forming process is started or at the start of the forming process, the low-temperature fluid F2 is switched to the high-temperature fluid F1, and hot water is fed to the die 16 so as to raise the temperature of the die 16.

Here, in FIG. 1, a reference numeral 23 represents a knockout, which is arranged below the punch 9 in a vertically movable manner, along the common center axis A1 shearing with said punch 9.

Next, the action of the apparatus having a construction thus far described, i.e., the method for the present invention will be described hereinafter. A cup-shaped in-process material 8 is set up in the die 16 with the punch 9 and the blank holder 14 being pulled to a top dead center. In this state, a clutch of the pressing machine (both are not shown) is turned on to lower the inner slide 1 and the outer slide 2. After that, the cup-shaped in-process material 8 is set by pinching its flange 8*b* with the blank holder 14 and the upper face of the die 16. Although a lowering of the outer slide 2 stops in this situation, the inner slide 1 is further lowered together with the punch 9 mounted thereon to enter into the cup-shaped in-process material 8 fixed in the die 16. Accordingly, the punch 9 and the die 16 work together and carry out the drawing/ironing of the cup-shaped in-process material 8.

In this case the aforementioned constant temperature water F3 is fed to the flow passage 10 of the punch 9 so that the punch 9 is kept at the predetermined temperature. Feeding of the constant temperature water F3 is carried out continuously during the forming process. Also, the aforementioned water at ambient temperature is fed to the die 16 in a circulating manner, so as to keep the die 16 in a cooled state or an unheated state. Therefore, the temperatures of the punch 9 and the die 16 are almost equal just before the forming process is started, and the clearance CL therebetween is kept to the predetermined dimension in the horizontal direction in FIG. 3. Moreover, the resin coating formed on both inner and outer sides of the cup-shaped in-process material 8 are kept within the allowable temperature range of slip deformation and elongation, by contacting with the punch 9 and the die 16.

The hot water from said high-temperature heat source 19 switched from ambient temperature water is fed to the die 16 by turning on the clutch to start the forming process, and the die 16 is thereby heated to raise the temperature thereof. Accordingly, the temperature of the die 16 is raised in accordance with a temperature rise of the surface of the punch 9 due to elongation and friction of the material of the cup-shaped in-process material 8 resulting from the drawing/ironing process. Therefore, the temperature difference between the punch 9 and the die 16 will not increase even in the beginning of the forming process, just after the start.

When the punch 9 is thus lowered to the bottom dead center, the drawing/ironing step is ended with the flange 8*b* being remained. The punch 9 moves upward together with the inner slide 1 first of all, then the blank holder 14 moves upward, and after that, the knockout 23 moves upward together with or following the upward movement of the blank holder 14, so as to push a finished product out of the die 16 upward. The finished product is sent to the not shown next ironing step. The bottom dead center of the punch 9 means that the punch 9 reaches the lowest position.

Here, since the cup-shaped in-process materials 8 are sent at short time interval, the aforementioned drawing/ironing step is carried out repeatedly in accordance with the feeding speed of the cup-shaped in-process materials 8. While the forming is being carried out, heating or warming of the die 16 is continued by feeding said hot water thereto. In case the drawing/ironing is halted in the process, due to an interruption in feeding of the cup-shaped in-process material 8 etc., or in case the clutch of the pressing machine is turned off, water having an ambient temperature is fed to the die 16 to cool the die 16, instead of said hot water.

According to the aforementioned apparatus and method, therefore, the die 16 is cooled before the drawing/ironing process is started, and is heated or kept warmed at the start of the forming, so that the temperature difference between the die 9 and the punch 16 can be minimized by raising the temperature of the die 16 in accordance with the temperature rise of the surface of the punch 9 resulting from the forming process of the cup-shaped in-process material 8. Therefore, variation in the wall thickness of the can body 8*a* of the seamless can as the finished product can be minimized, and occurring of defection in the process of the forming, such as the breakage of the can body, and the cracking of the resin coating can be prevented or suppressed.

Specifically, the die 16 is thermally expanded by raising the temperature of the die 16 aggressively. Here, the die 16 is easy to be expanded outward due to a clearance B1 provided between the wall face of the concave portion 4B of the die holder 4 and the outer circumferential face of the die 16, while the diameter of the opening 16A, i.e., the inner diameter of the die 16 is enlarged as a result of forming the opening 16A on the central portion of the die 16. Utilizing this phenomenon, the clearance CL between the punch 9 and the die 16 can be maintained.

Figure 5:
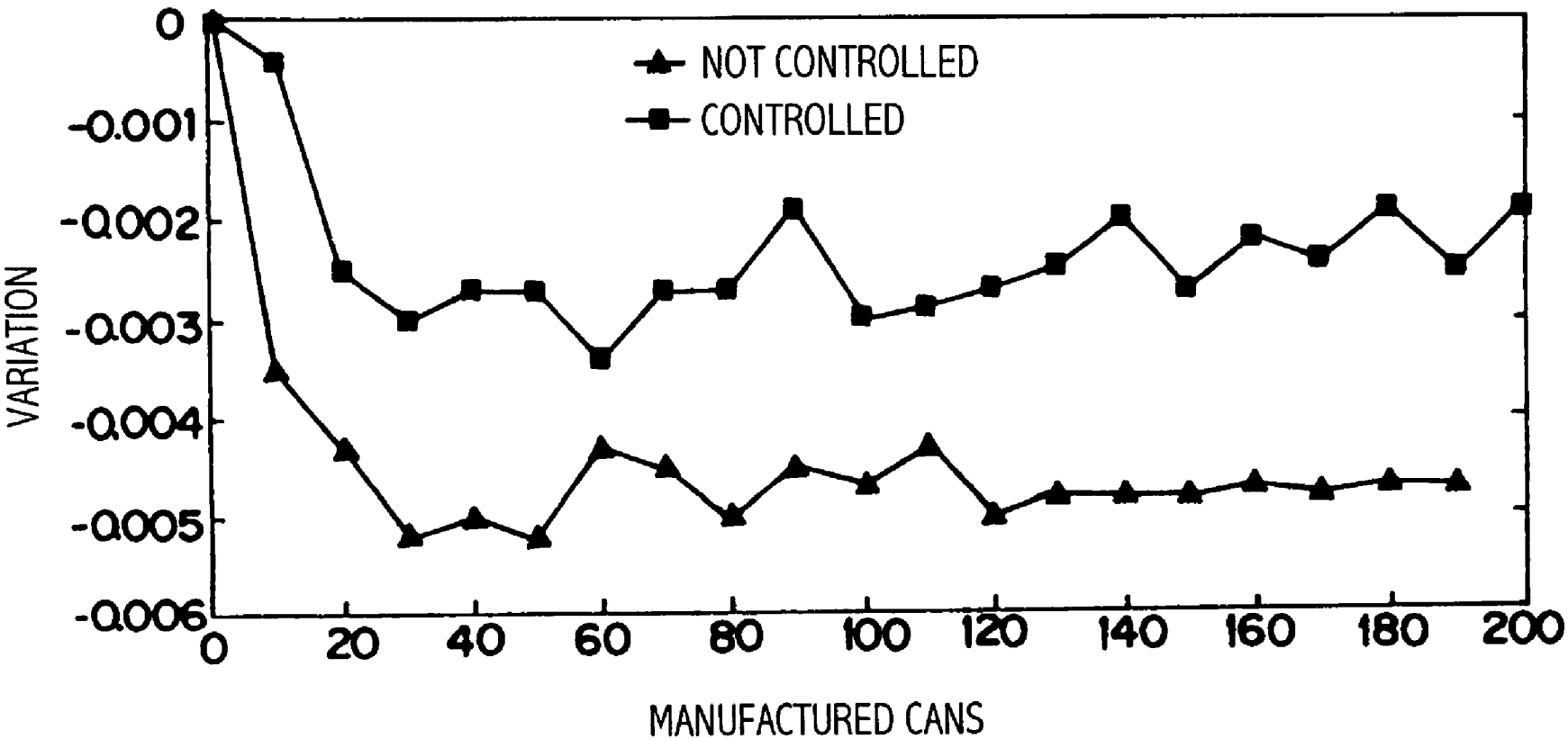
FIG. 5 is a diagram showing variation in a wall thickness of the can body in the first embodiment and a variation in a wall thickness of a can body of the prior art.

A result of the experiment devised by the inventors of the present invention is shown in FIG. 5. Details will be described hereinafter. A coated metallic sheet as a raw material is 3004H191 aluminum alloy sheet having a thickness of 0.315 mm, which is prepared by laminating a mixed resin film containing a polybutylene terephthalate resin (PBT) and a polyethylene terephthalate resin (PET) (PBT: PET=60:40) as a protecting coating layer of a crystalline polyethylene resin, 25 μm thick on the inner face, and 16 μm thick on the outer face. At the laminating step, the thermally adhering thermoplastic resin layer is once melted and then quenched into an amorphous state. Normal butyl stearate is applied to the resin layer of the resin-coated metallic sheet as a lubricant, and the blank, which is punched therefrom in a disc shape having a diameter of 170 mm, is drawn into a cup shape having a height of 48.3 mm and an external diameter of 100 mm. Then, by means of redrawing/ironing the cup, there is formed a bottomed cylindrical seamless can body which has a smaller diameter and a larger height than that of the cup, a thinned body portion, a height of 182 mm or larger and an internal diameter of 65.9 mm. FIG. 5 is a diagram showing a relation between the variation in the wall thickness of the can body and the number of manufactured cans. As shown in FIG. 5, in the case (■) where the temperature of the die 16 is controlled as thus far described, the reduction of the wall thickness of the can body is made smaller. On the other hand, in case (▲) where the temperature of the die 16 is not controlled, the reduction of the wall thickness of the can body, i.e., errors in the targeted wall thickness is made larger. Besides, the forming defect can be further reduced, provided that an opening/closing control of the high-temperature fluid to be fed to the die 16 is carried out sensitively on the basis of a experimental data obtained from various manufacturing speed, a type of material, an amount of production, a material of tooling, specifications of lubricant and a resin coating and so on, in accordance with the surface temperature of the punch detected by a known temperature sensor, during the period from the start of the forming until the temperature of the punch 9 is stabilized, or during the forming.

Here, although the aforementioned first embodiment shows one specific embodiment in which the invention is applied to drawing/ironing, the invention should not be limited to the specific embodiment, but can be applied to an apparatus and a method for drawing, or to an apparatus and a method for ironing only. Also, an appropriate means other than water and hot water described in the aforementioned embodiment, e.g., hot air, cold air, infrared ray or the like can be employed as the cooling and heating means for the die of the invention. Moreover, this embodiment can also be applied to an apparatus or a method for manufacturing a seamless can body without the flange 8*b* formed on the opening end portion.

(Second Embodiment)

Figure 6:
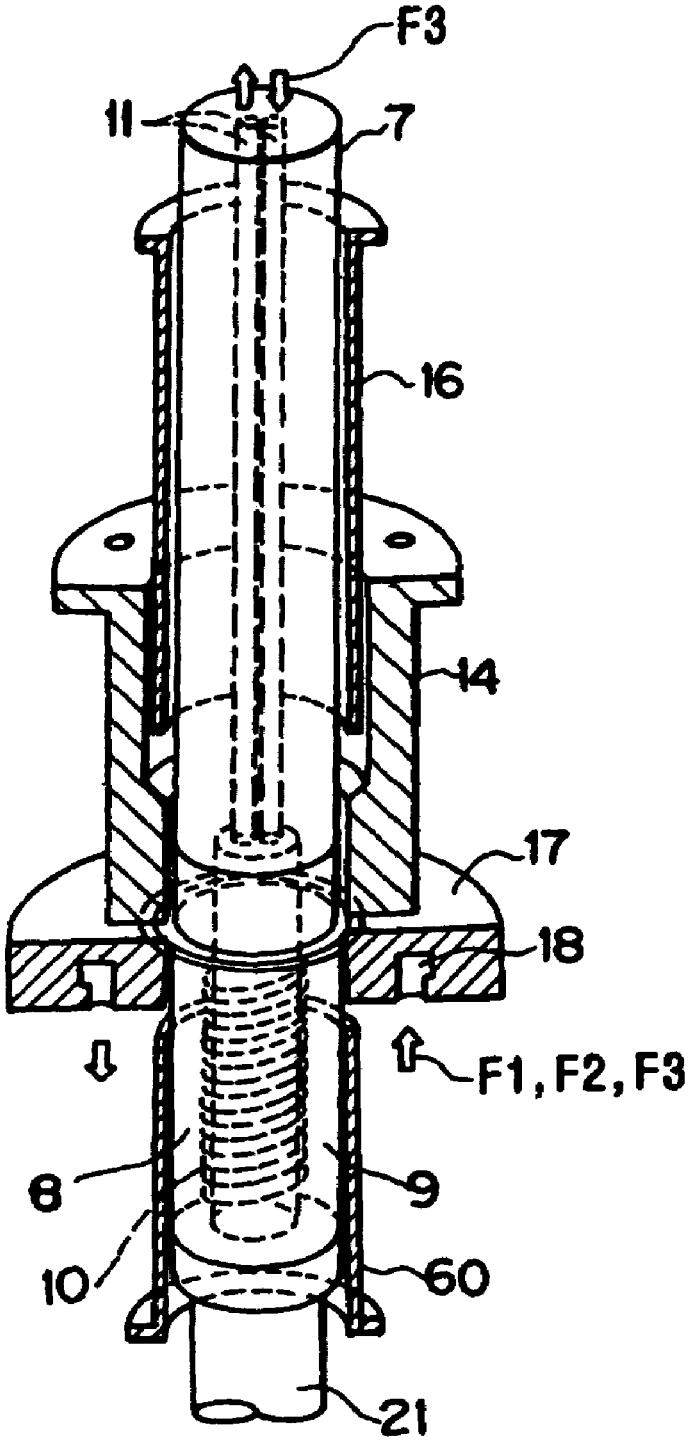
FIG. 6 is a sectional perspective view schematically showing a second embodiment of an apparatus according to the invention.
Figure 7:
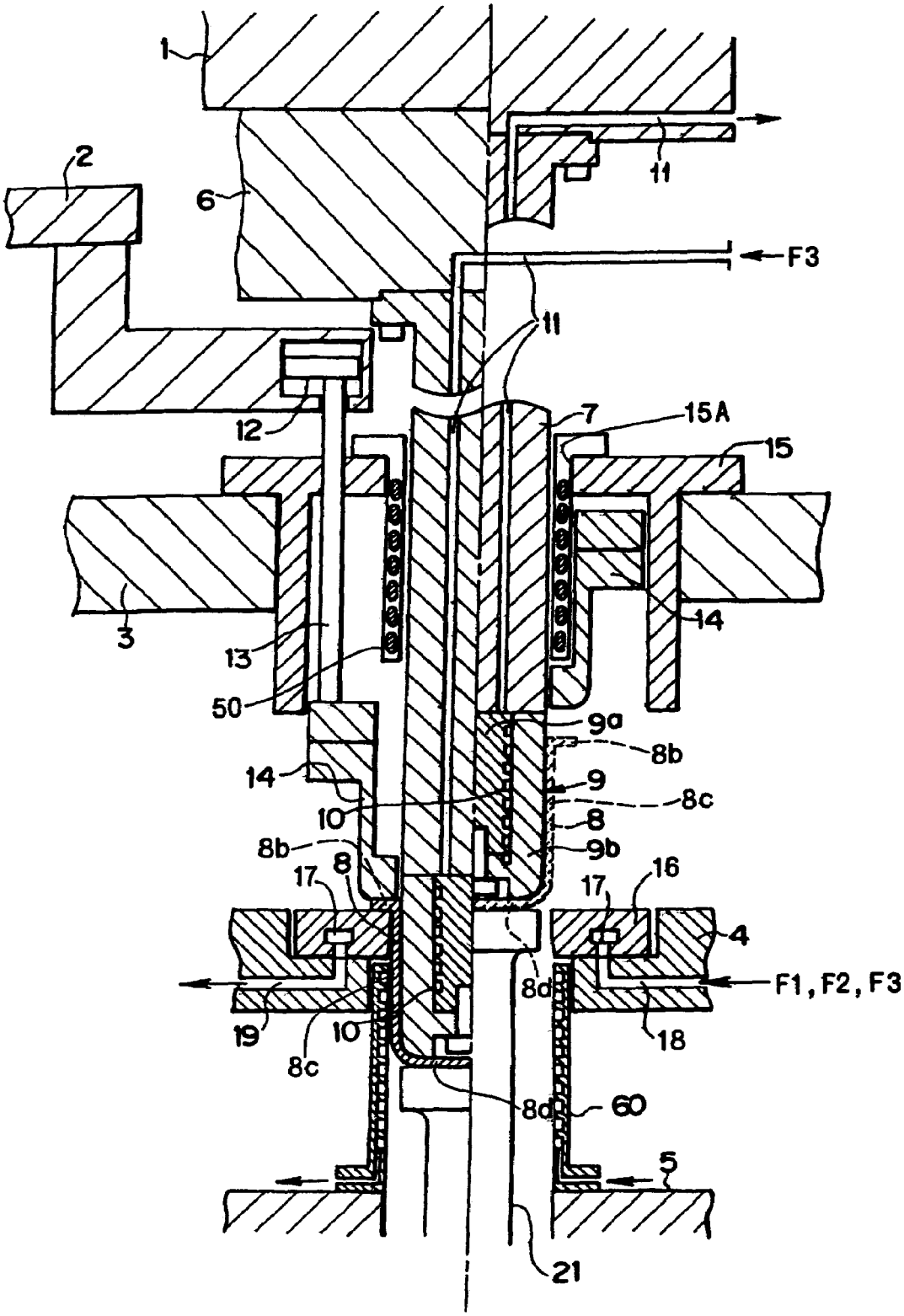
FIG. 7 is a sectional view schematically showing the apparatus shown in FIG. 6.

FIGS. 6 and 7 schematically show another embodiment of an apparatus to be used for carrying out the method of the invention by redrawing, the redrawing/ironing or ironing in the can body forming process. In the second embodiment, a construction similar to that of the first embodiment is designated by the common reference numerals.

There is installed a heat source sleeve 50 on the opening 15A of said blank holder guide 15. This heat source sleeve 50 heats the punch 9 from the outer face side, and is constructed of a cylinder incorporating an electric heater, a cylinder incorporating a built-in electromagnetic induction coil, or a cylinder constructed to blow a warm air or hot air from inside and so on. Here, the heat source sleeve 50 is made to have a length enough to heat the punch 9 positioned in the top dead center.

Moreover, there is arranged a cooling sleeve 60 below said die 16, for cooling both the punch 9 lowered to the bottom dead center and a formed body (i.e., a can body as a partly finished product) fitted with the punch 9 from the outer face side. The cooling sleeve 60 cools the can body 8*a* and the punch 9 by drawing heat generated as a result of the redrawing, the redrawing/ironing or the ironing, and as one example, the cooling sleeve is constructed to blow cold air to its inner circumferential side. Also, the cooling sleeve 60 has an inner diameter slightly larger than an outer diameter of the can body 8*a* fitted with the punch 9 in the bottom dead center, and a length to encompass at least the portion of the can body 8*a* leading downward from the die 16 entirely.

Next, a method of the invention using the apparatus having the aforementioned construction will be described hereinafter. The constant temperature water F3 having a constant temperature from 20 to 80° C. (preferably 50 to 70degrees C.) is fed continuously to the flow passage 10 of the punch 9 and the flow passage 17 of the die 16, even before the forming process is started, or even when the forming process is halted (i.e., in an idling state) due to interruption in the feeding of the cup-shaped in-process material 8, thereby to keep the punch 9 and the die 16 warmed from inside. In addition to this, the surface (i.e., the outer circumferential face) of the punch 9 is heated and kept warmed by the heat source sleeve 50 arranged on the top dead center side of the pinch 9. The surface temperature of the punch is higher than that of the unprocessed cup-shaped in-process material 8 sent from the preceding step, and approximate to the surface temperature of the punch to be reached in case of forming a number of the cup-shaped in-process material 8 continuously. More specifically, it is the temperature lower than that the punch 9 reaches, and can be exemplified by 50 to 120° C.

Generally, the temperature of the unprocessed cup-shaped in-process material 8 is somewhat higher than a room temperature in the factory where said apparatus is installed, or an ambient temperature by a residual heat (i.e., a processing heat) of the preceding step, and it can be obtained from a preliminary measurement. Also, the surface temperature of the punch 9 to be reached in case of a continuous processing (i.e., a continuous manufacturing) varies depending on the manufacturing speed, the type of material, the production amount, and the material of tools such as the punch 9 and the die 16 etc., however, it can be obtained from a preliminary measurement with setting those processing condition.

Since the punch 9 is kept warmed by the constant temperature water F3 as described above, the temperature is hardly affected by seasonal change. Therefore, the temperature of the punch 9 can be controlled by the heat source sleeve 50 easily and accurately, because a premised temperature is almost constant. In other words, the variation in the surface temperature of the punch 9 according to the season and the ambient air can be reduced.

The punch 9 and the blank holder 14 are pulled up to the top dead center, with the punch 9 is thus heated and warmed from the outer face side, and with the die 16 being warmed by the constant temperature water. In this state, the cup-shaped in-process material 8 formed at the preceding step is set in the die 16. The redrawing, or the redrawing/ironing or the ironing is applied to this cup-shaped in-process material 8 by lowering the punch 9 and the blank holder 14, however, operation of said heat source sleeve 50 is halted prior to the lowering of the punch 9 to halt the heating and warming of the punch 9.

Then, the clutch of the pressing machine (both are not shown) is turned on to lower the inner slide 1 and the outer slide 2. After this, the cup-shaped in-process material 8 is set up by pinching its flange with the blank holder 14 and the upper face of the die 16. Although a lowering of the outer slide 2 stops in this situation, the inner slide 1 is further lowered so that the punch 9 mounted thereon enters into the cup-shaped in-process material 8 fixed in the die 16. As a result, the forming of the cup-shaped in-process material 8 is carried out by cooperation of the punch 9 and the die 16.

In this case, the constant temperature water F3 is fed to the die 16 to keep it at the predetermined temperature, similarly to the first embodiment. Accordingly, the clearance CL between the punch 9 and the die 16 is kept at the predetermined distances at the start or restart of the forming process. Also, the resin coating formed on both inner and outer faces of the cup-shaped in-process material 8 is contacted with the punch 9 and the die 16, and is kept appropriately within the allowable temperature range of slip deformation and elongation, when it is formed. Therefore, forming defects such as the variation in the wall thickness, the brakeage of the can body 8*a*, the breakage of the flange 8*b*, the cracking of the resin coating and so on can be prevented or suppressed.

On the other hand, said cooling sleeve 60 is operated with the start of processing of the cup-shaped in-process material 8 set in the die 16. Accordingly, both the punch 9 lowered to the bottom dead center and the formed body (i.e., the cup-shaped in-process material 8) are cooled from the outer face side. In other words, although the processing heat arise from a frictional heat and an elongation of the material of the cup-shaped in-process material 8 etc. is generated when the punch 9 carries out a thinning to the cup-shaped in-process material 8, at least a part of the heat is drawn by the operation of the cooling sleeve 60. As a result, the cup-shaped in-process material 8 and the punch 9 are cooled and thereby easy to be kept within the predetermined temperature range.

The thinning is ended when the punch 9 is thus lowered to the bottom dead center, without forming the flange 8*b*. Then, the punch 9 moves upward together with the inner slide 1 first of all, then, the blank holder 14 moves upward, and after that, the knockout 21 moves upward together with or in accordance with the upward movement of the blank holder 14, so as to push the can body 8*b* out of the die 16 upward. In this case, the can body 8*b* fitted with the punch 9 is cooled by said cooling sleeve 60 so that engagement between the die 16 and the can body 8*b* is eased. As a result, the formed can body 8*a* can be knocked out (i.e., the releasing property) easily from the die 16. Also, the surface temperature of the resin coating can be lowered to the glass transitional point (Tg) of the resin or lower, so that an adhesion of the resin onto the surface of the punch 9 due to softening caused by processing heat can be suppressed or prevented. Therefore, the can body as the finished product can be stripped away from the punch 9 easily, and a damage of the resin coating due to scuffing can be avoided in advance.

Additionally, thus formed can body as the finished product is sent to the (not shown) next ironing step.

Since a plurality of cup-shaped in-process materials 8 are sent at short time interval, the aforementioned forming process of the can body 8*a* is carried out repeatedly in accordance with the feeding speed of the cup-shaped in-process material 8. Besides, nothing but said constant temperature water is fed to the punch 9 while the forming of the can body 8*a* is being carried out, and the heating of the heat source sleeve 50 is not carried out. If the forming process of the can body 8*a* is halted in the process due to an interruption in the feeding of the cup-shaped in-process material 8 or the like, so-called "idling state" in which only the punch 9 simply moves vertically may occur, or the clutch of the pressing machine may be turned off and the punch 9 may stopped at the top dead center. In this case, the punch 9 is heated and warmed by the heat source 50 after appropriate time out, so as to prepare for the restart of the next forming process.

Thus, according to the method of the present invention, the temperature of the punch 9 is set higher than that of the cup-shaped in-process material 8, and at a temperature approximate to that of the surface of the punch 9 to be reached in case of forming a number of the can body 8*a* continuously, prior to starting the substantial forming process of the cup-shaped in-process material 8 by the punch 9. Therefore, the clearance CL between the punch 9 and the die 16 is kept the predetermined distance, and a relative misalignment is avoided. Therefore, the forming defects such as the variation in the wall thickness and the brakeage of the can body 8*a*, and the breakage and the cracking of the flange 8*b* can be solved. Also, the temperature of the resin coating provided on the surface of the cup-shaped in-process material 8 can be set to the temperature suitable for the processing, so that the forming defects such as the breakage and the cracking of the resin coating may be prevented. In other words, a defective fraction at the start or restart of the forming process can be reduced, therefore, a material yield and a productivity can be improved.

While processing heat is generated in accordance with the forming process, moreover, the punch 9 and the can body fitted with the outer circumference of the punch 9 are cooled together, and the processing heat thereof is drawn at least partially. Therefore, the temperature of the punch 9 will not be raised abnormally and kept to the predetermined temperature, even if the forming process is carried out continuously. Especially, as mentioned above, the temperature control of the punch 9 is carried out by heating or cooling the entire circumference of the punch 9 evenly by the cooling sleeve 60 or the heat source sleeve 50, so that the responsiveness to the temperature control is preferable and a variation in the temperature is reduced.

Figure 8:
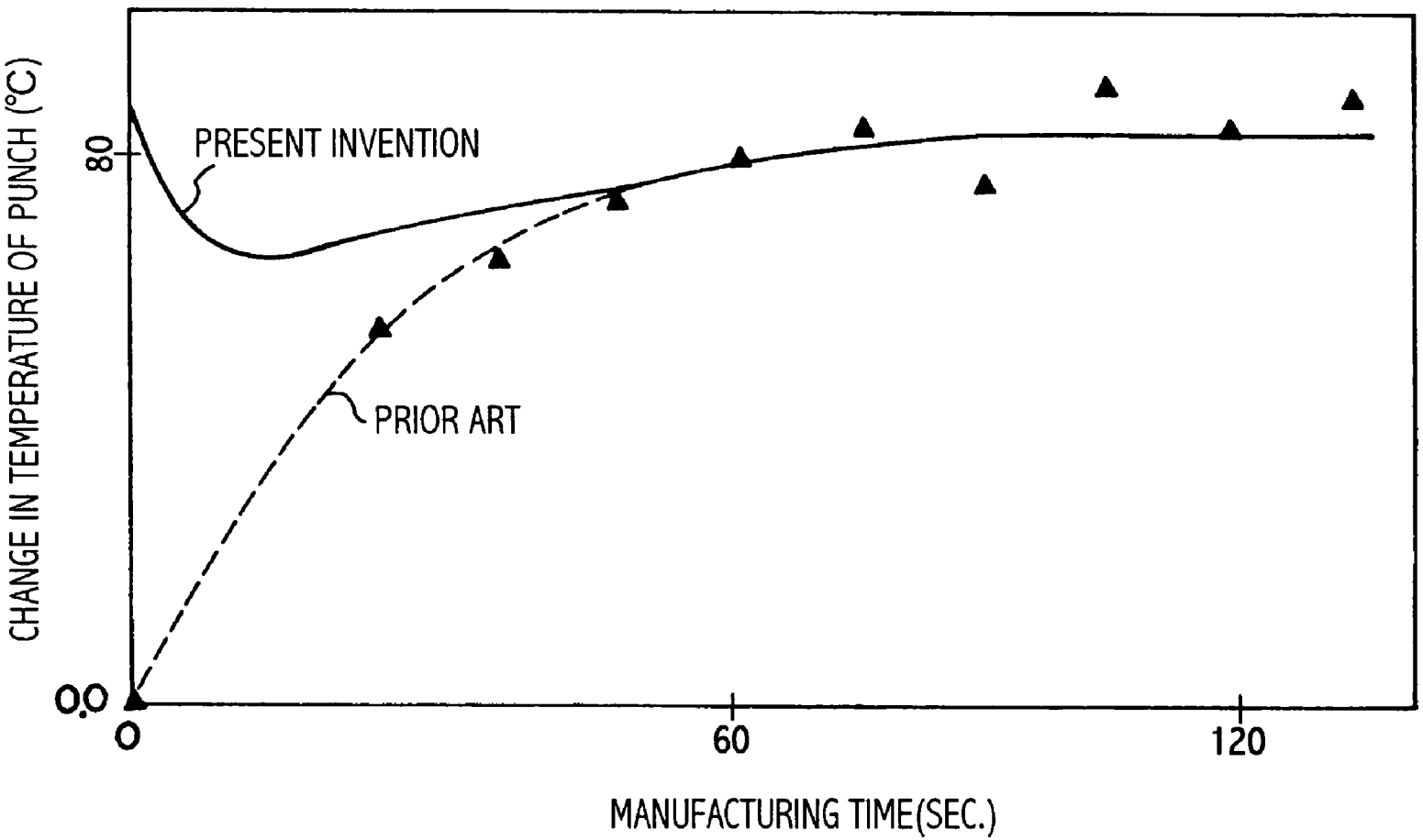
FIG. 8 is a diagram showing a measurement result of a variation in a temperature of the punch, by comparing the invention with the prior art.
Figure 9:
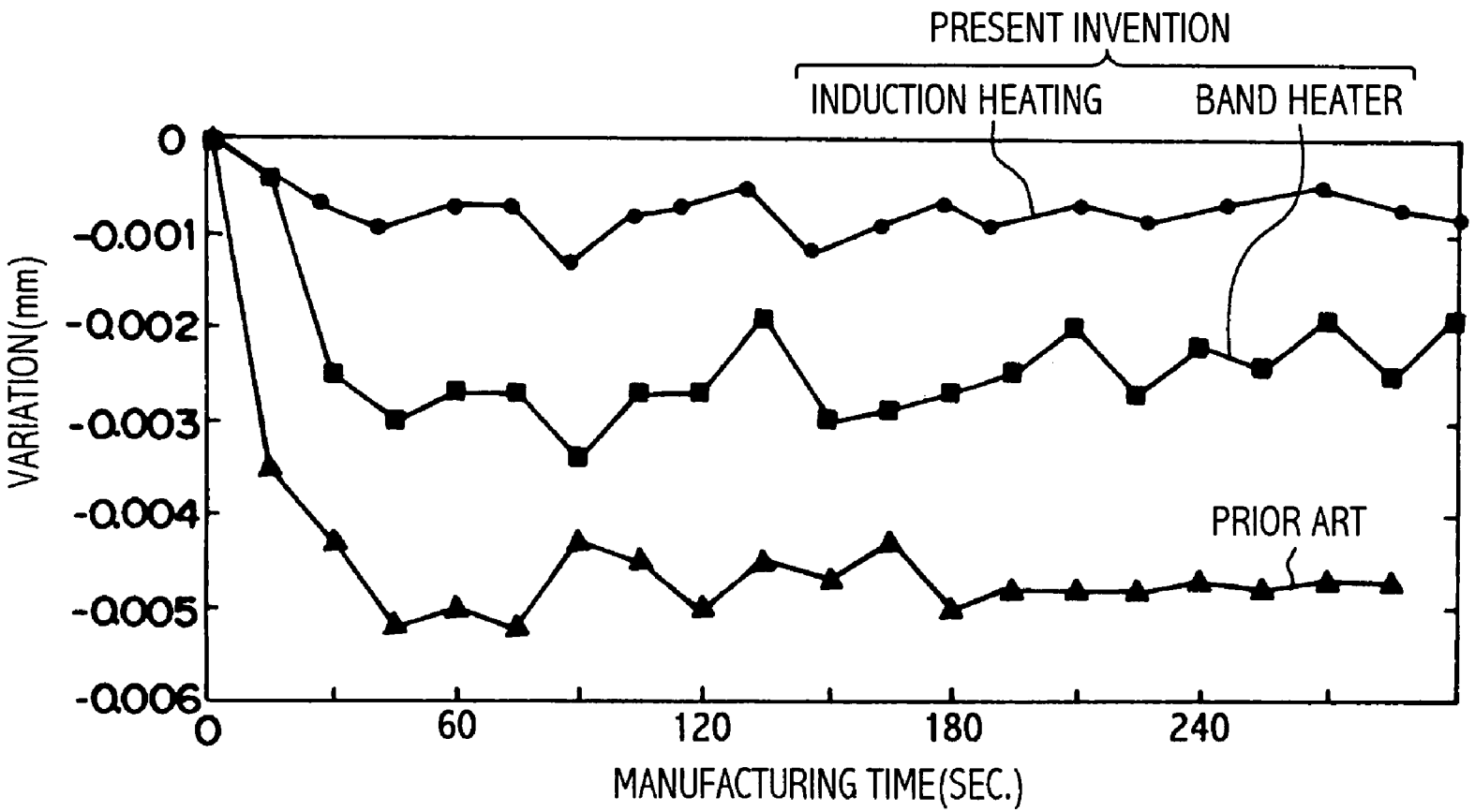
FIG. 9 is a diagram showing a measurement result of variation in a wall thickness of the can body, by comparing the invention with the prior art.

Here, the result of the experiment devised by the inventors of the present invention is shown in FIGS. 8 and 9. The object of the measurement is the forming process such that the resin-coated metallic sheet similar to that used in the first embodiment is punched out in a disc shape to obtain a blank having a diameter of 170 mm, and this blank is drawn to form a cup-shaped in-process material having a height of 48 mm and an outer diameter of 100 mm, which is redrawn into a bottomed cylindrical can body having a height of 182 mm and an inner diameter of 65.9 mm.

FIG. 8 is a diagram showing a measurement result of temperature change of the punch after the forming is started in 100 SPM. In the figure, a solid line indicates an example of the invention, and a dashed line indicates an example of the prior art in which the punch is not heated from the outer face side by the heat source sleeve. As evidenced by the measurement result shown in FIG. 8, according to the method of the invention, the temperature of the punch is kept to the temperature level of the continuous forming, from the beginning of the forming. Therefore, defective forming due to the temperature difference between the punch and die, or the temperature condition such as the temperature change of the punchy can be suppressed or avoided.

Moreover, FIG. 9 is a diagram showing a measurement result of a variation in the wall thickness of the can body. Measurement results of an example in which a sleeve for carrying out an induction heating is employed as said heat source sleeve 50, an example in which a band heater incorporating an electric heater is employed, and an example of the prior art in which the heating by the heat source sleeve is not carried out, are shown therein. As evidenced by the measurement result shown in FIG. 9, according to the method of the invention, the variation in the wall thickness after the start of the forming is little, and a preferable redrawing/ironing can be carried out. In the second embodiment, it is also possible to feed the low-temperature fluid F2 having a temperature of 30° C. or lower into the die in advance, and to switch from the low-temperature fluid F2 to the high-temperature fluid F1 having a temperature of 50 to 80° C., at or just before the start of the forming process.

Figure 2:
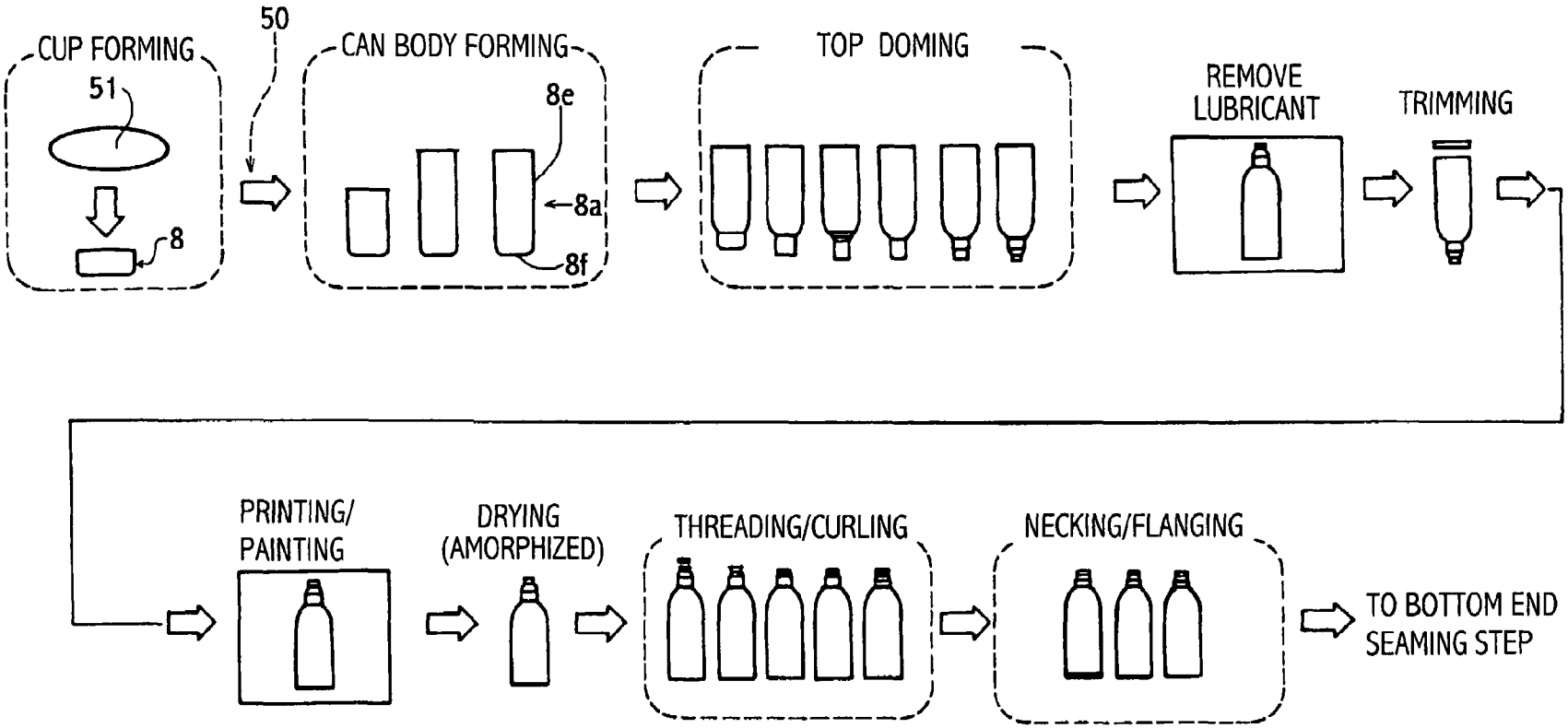
FIG. 2 is a process chart schematically showing one embodiment of a seamless can body forming process, to which the invention is applied.

Here, there is shown an example of heating, warming and cooling the punch 9 and the die 16 in the above embodiment, however, according to the method of the invention, it is also possible to control the temperature of the cup-shaped in-process material 8 as a forming object. As shown in FIG. 2, for example, it is preferable to heat/warm at least the trunk wall 8*c* of the cup-shaped in-process material 8 to the temperature of 20 to 80° C. before the start of the processing, by providing a second heating means 53 between the cup forming step and the can body forming step. With this construction, a lubricating property of the resin coating formed on the surface of the cup-shaped in-process material 8 becomes preferable, and the forming takes place at the temperature around the glass transitional point of the resin, so that the formability becomes preferable.

In the second embodiment, there is described the an example of carrying out the redrawing/ironing, however, the second embodiment can also be applied to any of the redrawing, a thinning/stretching and the ironing. Moreover, it is possible to control to change an output of the heat sources such as the band heater and an induction heating coil according to the material of the punch, the clearance between the heat source sleeve and the punch or its length. Furthermore, the second embodiment can also be applied to a method or an apparatus for manufacturing a seamless can body in which the flange is not formed on the opening.

Herebelow will now be described the corresponding relations between the construction described in the embodiments and the construction of this invention. The blank 80 corresponds to the resin-coated metallic sheet of the invention; the flow passage 17, the feeding/draining passage 18, the high-temperature heat source 19, the low-temperature heat source 20, the selector valve 21, and the controller 22 correspond to the heating/cooling means of the invention; the redrawing, the redrawing/ironing, or the ironing corresponds to the forming process of the invention; the feeding/draining passage 11 of the punch-shaft 7 correspond to the constant temperature water feeding means of the invention; the heat source sleeve 50 corresponds to the first heating means of the invention; and the cooling sleeve 60 corresponds to the cooling means of the invention.

INDUSTRIAL APPLICABILITY

The present invention can be utilized in an apparatus and a method for manufacturing the seamless can body by drawing a metallic sheet coated with a thermoplastic resin on both sides by using a punch and a die so as to form a cup-shaped in-process material, and by redrawing, redrawing/ironing or ironing the cup-shaped in-process material.

The invention claimed is:

1. An apparatus for manufacturing a resin-coated metal seamless can body having a bottom portion by redrawing, by redrawing and ironing, or by ironing a cup-shaped in-process material formed by drawing a resin-coated metallic sheet covered with a thermoplastic resin on both sides, by using a punch and a die, comprising:

heating means for heating the die, wherein the heating means does not heat the die prior to the forming process, and the heating means heats the die when the forming process can be carried out by the punch and die;

means for feeding water at a constant temperature of between 20 and 80° C. into the punch during the process of forming the can body;

first heating means for heating the outer surface of the punch prior to starting or restarting the process of forming the can body, so that the surface temperature of said punch is higher than that of the cup-shaped in-process material prior to starting the process of forming the can body, and the temperature of the punch is approximately equal to the desired temperature required to continuously form a plurality of can bodies and the heating of the punch is halted just prior to starting or re-starting the process of forming the can body; and the process of forming the can body is carried out using the heated punch.

2. An apparatus for manufacturing a resin-coated metal seamless can body as claimed in claim 1, further comprising cooling means for cooling the die by feeding a low-temperature fluid into said die; wherein the heating means heats the die by feeding a high-temperature fluid into said die.

3. An apparatus for manufacturing a resin-coated seamless can body as claimed in claim 2, wherein:

said low-temperature fluid comprises water at a temperature of 30° C. or lower.

4. An apparatus for manufacturing a resin-coated metal seamless can body as claimed in claim 2, wherein said high-temperature fluid comprises hot water at a temperature of between 50 and 80° C.

5. An apparatus for manufacturing a resin-coated metal seamless can body as claimed in claim 1, comprising means for feeding water at a constant temperature between 20 and 80° C. into the punch during the process of forming the can body.

6. An apparatus for manufacturing a resin-coated metal seamless can body as claimed in claim 1, which comprises a cooling sleeve for cooling the outer surface of the can body fitted with the punch, when the punch is at a lowest position thereof within the can body during the continuous process of forming plurality of can bodies.

7. An apparatus for manufacturing a resin-coated metal seamless can body as claimed in claim 1, which comprises a second heating means for heating at least a trunk wall of said cup-shaped in-process material to between 20 and 80° C. prior to starting said forming process.

8. A method for manufacturing a resin-coated metal seamless can body having a bottom portion by redrawing, by redrawing/ironing, or by ironing a cup-shaped in-process material formed by drawing a resin-coated metallic sheet covered with a thermoplastic resin on both sides, by using a punch and a die, which comprises:

preventing heating of the die prior to the forming process, and heating the die during the forming process;

feeding water at a constant temperature of between 20 and 80° C. into the punch prior to starting the continuous process of forming the can body;

heating the punch from the outer surface prior to starting or restarting the forming process for forming said can body, so that the surface temperature of said punch is higher than that of the cup-shaped in-process material prior to starting the process of forming the can body, and the temperature of the punch is approximately equal to the desired temperature required to continuously form a plurality of the can bodies;

halting heating of said punch just before the process of forming the can body is started, or just before the halted forming process is restarted; and carrying out said forming process using a heated punch.

9. A method for manufacturing a resin-coated metal seamless can body as claimed in claim 8, which comprises:

maintaining the unheated temperature of the die prior to the forming process by feeding a low-temperature fluid into said die; and heating the die by feeding a high-temperature fluid into said die.

10. A method for manufacturing a resin-coated metal seamless can body as claimed in claim 9, wherein the low-temperature fluid comprises water at a temperature of 30° C. or lower.

11. A method for manufacturing a resin-coated metal seamless can body as claimed in claim 9, wherein the high-temperature fluid comprises water having a temperature between 50 and 80° C.

12. A method for manufacturing a resin-coated metal seamless can body as claimed in claim 8, which comprises:

feeding water at a constant temperature of between 20 and 80° C. into the punch during the process of forming the can body.

13. A method for manufacturing a resin-coated metal seamless can body as claimed in claim 8, which comprises cooling the can body fitted with the punch from the outer surface of the can body when the punch is at a lowest position thereof within the can body during the continuous process of forming a plurality of can bodies.

14. A method for manufacturing a resin-coated metal seamless can body as claimed in claim 8, which comprises heating at least the trunk wall of said cup-shaped in-process material to between 20 and 80° C. prior to starting the forming process.

* * * * *